US009577339B2

(12) United States Patent
Kashiwagi et al.

(10) Patent No.: US 9,577,339 B2
(45) **Date of Patent: *Feb. 21, 2017**

(54) ANTENNA DEVICE AND ELECTRONIC DEVICE

(71) Applicant: Kabushiki Kaisha Toshiba, Tokyo (JP)

(72) Inventors: Ippei Kashiwagi, Ome (JP); Koichi Sato, Tachikawa (JP); Hiroyuki Hotta, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 431 days.

This patent is subject to a terminal disclaimer.

(21) Appl. No.: 14/133,054

(22) Filed: Dec. 18, 2013

(65) Prior Publication Data

US 2014/0354484 A1 Dec. 4, 2014

(30) Foreign Application Priority Data

May 31, 2013 (JP) ..... 2013-115848

(51) Int. Cl.

| | |
|---|---|
| ***H01Q 9/42*** | (2006.01) |
| ***H01Q 1/24*** | (2006.01) |
| ***H01Q 1/38*** | (2006.01) |
| ***H01Q 5/335*** | (2015.01) |
| ***H01Q 5/371*** | (2015.01) |
| ***H01Q 5/378*** | (2015.01) |

(52) U.S. Cl.

CPC ..... *H01Q 9/42* (2013.01); *H01Q 1/243* (2013.01); *H01Q 1/38* (2013.01); *H01Q 5/335* (2015.01); *H01Q 5/371* (2015.01); *H01Q 5/378* (2015.01)

(58) Field of Classification Search

CPC ..... H01Q 9/42; H01Q 5/378; H01Q 1/38

See application file for complete search history.

(56) References Cited

U.S. PATENT DOCUMENTS

| | | | | |
|---|---|---|---|---|
| 7,136,022 | B2 * | 11/2006 | Sato | H01Q 9/26 343/702 |
| 7,345,637 | B2 | 3/2008 | Mizoguchi et al. | |
| 7,358,906 | B2 | 4/2008 | Sato et al. | |
| 7,477,199 | B2 | 1/2009 | Hotta et al. | |
| 7,515,111 | B2 | 4/2009 | Tsujimura et al. | |
| 7,570,218 | B2 | 8/2009 | Tsujimura et al. | |
| 7,675,469 | B2 | 3/2010 | Ohba et al. | |
| 7,764,238 | B2 | 7/2010 | Hotta et al. | |

(Continued)

FOREIGN PATENT DOCUMENTS

| | | |
|---|---|---|
| JP | 2012-212960 | 11/2012 |
| JP | 5127966 | 11/2012 |

*Primary Examiner* — Hoang V Nguyen
*Assistant Examiner* — Michael Bouizza
(74) *Attorney, Agent, or Firm* — Rutan & Tucker, LLP

(57) ABSTRACT

According to one embodiment, an antenna device includes a first antenna, a second antenna, a third antenna, a capacitor element, a high-frequency cable, and a base member. The first antenna includes a folded-type monopole element. The second antenna includes a monopole element. The third antenna includes a passive element. The capacitor element is between a feeding point and a stub in a backward-path portion of the first antenna. The high-frequency cable is connected to the feeding point. The base member is formed of a dielectric material and has first, second, and third surfaces located to extend in different directions. The first, second, and third antenna are located at the first, second, and third surfaces.

18 Claims, 6 Drawing Sheets

(56) References Cited

U.S. PATENT DOCUMENTS

| | | | | |
|---|---|---|---|---|
| 7,791,546 | B2 | 9/2010 | Hotta et al. | |
| 7,825,861 | B2 | 11/2010 | Sato et al. | |
| 7,830,323 | B2 | 11/2010 | Tsujimura et al. | |
| 7,847,750 | B2 | 12/2010 | Ohba et al. | |
| 7,982,678 | B2 | 7/2011 | Hotta et al. | |
| 8,098,204 | B2 | 1/2012 | Tsujimura et al. | |
| 8,106,844 | B2 | 1/2012 | Tsujimura et al. | |
| 8,170,635 | B2 | 5/2012 | Ohba et al. | |
| 8,185,061 | B2 | 5/2012 | Sato et al. | |
| 8,614,647 | B2 | 12/2013 | Hotta et al. | |
| 8,699,964 | B2 | 4/2014 | Ohba et al. | |
| 8,779,987 | B2 | 7/2014 | Endo et al. | |
| 8,836,588 | B2 | 9/2014 | Hayashi et al. | |
| 8,941,548 | B2 | 1/2015 | Kashiwagi et al. | |
| 8,942,641 | B2 | 1/2015 | Ohba et al. | |
| 8,988,292 | B2 * | 3/2015 | Hotta | H01Q 1/243 343/700 MS |
| 9,059,499 | B2 | 6/2015 | Hotta et al. | |
| 2005/0153756 | A1 * | 7/2005 | Sato | H01Q 1/243 455/575.7 |
| 2008/0169981 | A1 * | 7/2008 | Hotta | H01Q 1/243 343/700 MS |
| 2009/0079639 | A1 * | 3/2009 | Hotta | H01Q 1/243 343/702 |
| 2011/0183633 | A1 * | 7/2011 | Ohba | H01Q 1/243 455/77 |
| 2012/0249393 | A1 | 10/2012 | Hotta et al. | |
| 2013/0050036 | A1 | 2/2013 | Kashiwagi et al. | |

* cited by examiner

ANTENNA DEVICE AND ELECTRONIC DEVICE

CROSS-REFERENCE TO RELATED APPLICATIONS

This application is based upon and claims the benefit of priority from Japanese Patent Application No. 2013-115848, filed May 31, 2013, the entire contents of which are incorporated herein by reference.

FIELD

Embodiments described herein relate generally to an antenna device and an electronic device including the antenna device.

BACKGROUND

In recent years, portable electronic devices such as smart phones, personal digital assistant (PDAs), tablet terminals and notebook personal computers have been required to have a lighter, thinner and smaller housing in order to decrease their sizes and weights. Accordingly, antenna devices for the portable electronic devices have also been required to be made more compact. Also, in recent years, the portable electronic device have been required capable of performing communication in a wider frequency band, in order that they can each communicate with a plurality of wireless systems having different frequency bands.

In view of the above, antenna devices have been proposed in which in addition to a folded-type monopole element, a second monopole element and a passive element are added in order to widen a resonant band. Also, antenna devices have been proposed in which a capacitor element is provided close to a feeding point of a folded-type monopole element provided with a stub in order to widen an operation frequency band.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Figure 1:
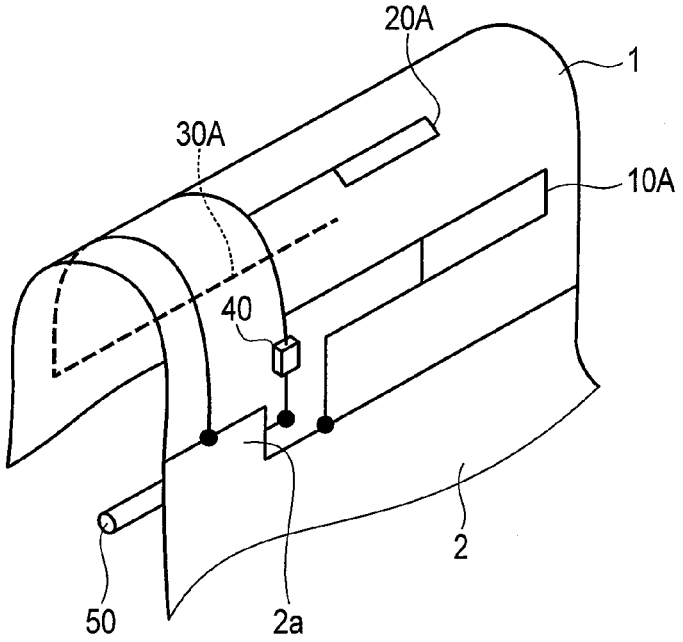
FIG. 1 is an exemplary perspective view of a structure of an antenna device according to a first embodiment.

Various embodiments will be described hereinafter with reference to the accompanying drawings.

In general, according to one embodiment, an antenna device includes a first antenna element, a second antenna element, a third antenna element, a capacitor element, a high-frequency cable, and a base member.

The first antenna element includes a folded-type monopole element having a first end and a second end. The first end is connected to a feeding point. The second end is connected to a first grounding terminal. The folded-type monopole element includes an intermediate portion folded to divide the folded-type monopole element into a forward-path portion and a backward-path portion. A stub is located between the forward-path portion and the backward-path portion. An electrical length from the feeding point to the first grounding terminal through the intermediate portion is set in accordance with a wavelength corresponding to a first resonant frequency.

The second antenna element includes a monopole element having a third end and a fourth end. The third end is directly connected to the feeding point or indirectly connected to the feeding point by part of the first antenna element. The fourth end of the monopole element is free. At least a distal end portion of the monopole element is located to extend in parallel with the first antenna element. An electrical length from the feeding point to the fourth end is set in accordance with a wavelength corresponding to a second resonant frequency higher than the first resonant frequency.

The third antenna element includes a passive element having a fifth end and a sixth end. The fifth end is connected to a second grounding terminal. The sixth end is free. The second grounding terminal is located opposite to the first grounding terminal with respect to the feeding point. At least part of the passive element is located to extend in parallel with the second antenna element to achieve capacitive coupling between the at least part of the passive element and the second antenna element. An electrical length from the second grounding terminal to the sixth end is set in accordance with a wavelength corresponding to a third resonant frequency higher than the second resonant frequency.

The capacitor element is between the feeding point and the stub in the backward-path portion of the first antenna element.

The high-frequency cable is connected to the feeding point.

The base member is formed of a dielectric material and has first, second, and third surfaces located to extend in different directions.

The first antenna element is located at the first surface of the base member, the second antenna element is located at the second surface of the base member, the third antenna element is located at the third surface of the base member, and the capacitor element and the high-frequency cable are located on an extension of the first surface of the base member.

[First Embodiment]

An electronic device according to a first embodiment includes a notebook personal computer, a smart phone, a personal digital assistant or a tablet terminal provided with a wireless interface. An antenna device according to the first embodiment is disposed at the electronic device to provide the wireless interface.

Figure 2:
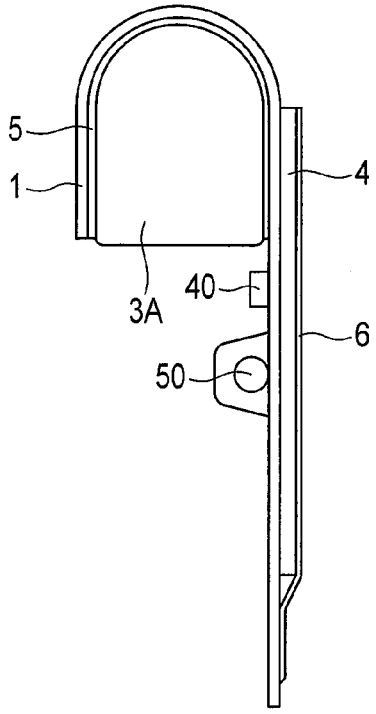
FIG. 2 is an exemplary side view of the antenna device shown in FIG. 1.
Figure 3:
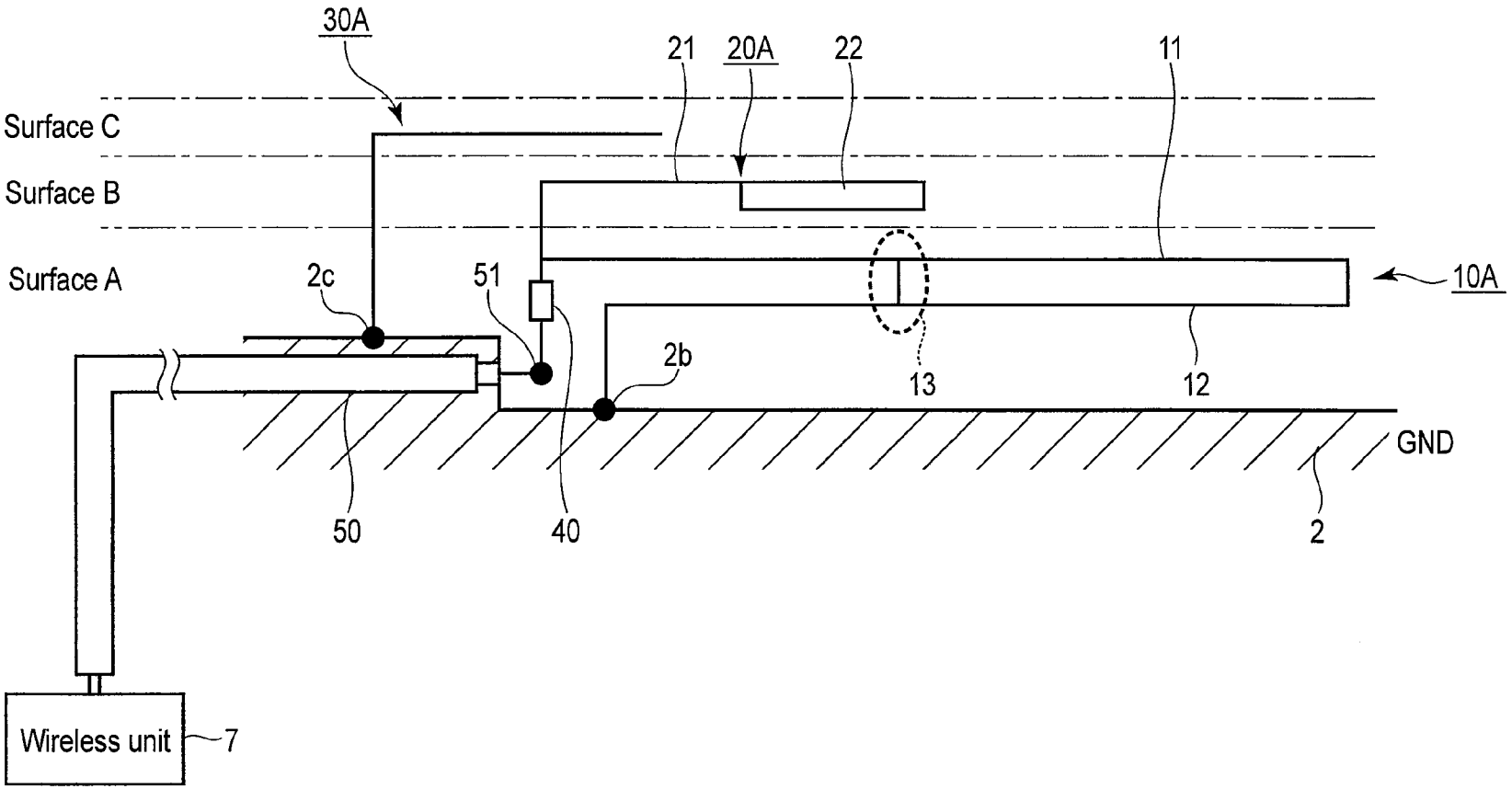
FIG. 3 is an exemplary view showing a two-dimensionally developed state of the antenna device shown in FIG. 1 and a wireless unit of an electronic device.

FIG. 1 is a perspective view of a structure of the antenna device according to the first embodiment. FIG. 2 is a side view of the antenna device, and FIG. 3 is a view showing a two-dimensionally developed state of the antenna device.

The antenna device according to the first embodiment uses a flexible printed cable (FPC) 1 as a base. The flexible printed cable 1 includes a first region in which a grounding pattern 2 is formed and a second region in which the grounding pattern 2 is not formed. In the first region where the grounding pattern 2 is formed, first and second grounding terminals 2*b* and 2*c* are provided.

In the second region where the grounding pattern 2 is not formed, a feeding point 51 is provided. To the feeding point 51, one of the ends of a high-frequency cable 50 is connected. The high-frequency cable 50 is extended along the grounding pattern 2, and the other end of the high-frequency cable 50 is connected to a wireless unit of the electronic device. It should be noted that the grounding pattern 2 is formed to partially project toward the second region, and the high-frequency cable 50 is provided to extend over a back side of a projected portion 2*a* of the grounding pattern 2.

Furthermore, first, second and third antenna elements 10A, 20A and 30A are provided. Of those antenna elements, the first antenna element 10A is located closest to the grounding pattern 2, and then the second antenna element 20A and the third antenna element 30A are arranged in this order in a direction away from the grounding pattern 2.

The first antenna element 10A includes a folded-type monopole element. The folded-type monopole element includes a conductive pattern which is folded in a hairpin manner at a substantially center portion of the conductive pattern. One of ends of the folded-type monopole element is connected to the feeding point 51, and the other is connected to the first grounding terminal 2*b*, Furthermore, a stub 13 is connected between a forward-path portion 11 and a backward-path portion 12, which are formed by folding the conductive pattern in the above manner. A length of the folded type monopole element (the first antenna element 10A) is set such that an electrical length from the feeding point 51 to the first grounding terminal 2*b* through the folded part of the conductive pattern is set to be substantially half a wavelength corresponding to a first predetermined resonant frequency.

The second antenna element 20A includes a monopole element. The monopole element includes an L-shaped conductive pattern. A proximal end of the conductive pattern is connected to the feeding point 51 by part of the first antenna element 10A, and a distal end of the conductive pattern is free. To be more specific, a distal end portion 22 of the second antenna element 20A is formed in the shape of a plate having a predetermined width. A length of the second antenna element 20A is set such that an electrical length from the feeding point 51 to the distal end is substantially one fourth a wavelength corresponding to a second predetermined resonant frequency f2.

The third antenna element 30A includes a passive element. The passive element also includes an L-shaped conductive pattern. The proximal end of this conductive pattern is connected to a second grounding terminal 2*c*, and a distal end of the conductive pattern is free. On a distal end side of the third antenna element 30A, the third antenna element 30A has a horizontal portion which is provided such that a distal end portion of the horizontal portion extends in parallel with a horizontal portion of the first antenna element 20A, in order to achieve current coupling between the above distal end portion of the horizontal portion of the third antenna element 30A and the horizontal portion of the first antenna element 20A. A length of the third antenna element 30A is set such that an electrical length from the second grounding terminal 2*c* to its distal end is substantially one fourth a wavelength corresponding to a third predetermined resonant frequency f3.

The first resonant frequency f1 is set to fall within a band (700 MHz to 900 MHz) which is used in a wireless system adopting, e.g., Long Term Evolution (LTE). The second resonant frequency f2 is set to fall within a band (1.7 GHz to 1.9 GHz) which is used in a wireless system adopting, e.g., 3G. The third resonant frequency f3 is set to fall within a band which is higher than and close to the second resonant frequency f2 in order to widen a band which is used in, e.g., the above wireless system adopting LTE or 3G. That is, the first frequency f1, the second frequency f2 and the third frequency f3 are set to satisfy the relationship "f1<f2<f3".

In the first antenna element 10A, a capacitor element 40 is provided between the stub 13 and the feeding point 51 of the forward-path portion 11. The capacitor element 40 generates another resonance mode in a folded side of the first antenna element 10A, i.e., an area from an end of the backward-path portion 12 of the first antenna element 10A to the first grounding terminal 2*b*, in order to widen the band of the antenna device. A capacitance C [pF] of the capacitor element 40 is set to fall within the range of $1/\omega_1 C<250$ [Ω], where $\omega_1$ is an angular frequency corresponding to the first resonant frequency f1. However, in 900 MHz band, the capacitance C of the capacitor element 40 needs to be set equal to or higher than approximately 0.7 pF in order that a voltage standing-wave ratio (VSWR) be kept at less than 5 which is a threshold value.

The antenna device according to the first embodiment includes a molded member 3A formed of resin. The molded member 3A, as shown in FIGS. 1 and 2, has two opposite side surfaces (A and C surfaces) and an upper surface (B surface) semicircularly projected.

The flexible printed cable 1 of the antenna device is located to be curved along the surfaces A, B and C of the molded member 3A. In this curved state, the flexible printed cable 1 is fixed to the surfaces A, B and C of the molded member 3A by an adhesive member 5 such as a double-faced adhesive tape. That is, the antenna device is folded at its intermediate part, i.e., it is U-shaped.

Furthermore, when the flexible printed cable 1 of the antenna device is curved along the peripheral surface of the molded member 3A in the above manner, as shown in FIG. 3, the first antenna element 10A, the second antenna element 20A and the third antenna element 30A are positioned at the surface A, the surface B and the surface C, respectively. In such a manner, the first, second and third antenna elements 10A, 20A and 30A are located at respective three surfaces (surfaces A, B and C) of the molded member 3A. In addition, the capacitor element 40 and the high-frequency cable 50, as shown in FIG. 2, have a given thickness, and are thus located below the molded member 3A.

Also, as shown in FIG. 2, a reinforcing member 4 is provided to reinforce the flexible printed cable 1 of the antenna device, and fixed to a housing not shown of the antenna device by an adhesive member 6 such as a double-faced adhesive tape.

As explained above in detail, according to the first embodiment, the flexible printed cable 1 where the first, second and third antenna elements 10A, 20A and 30A are formed is curved along the peripheral surface (surfaces A, B and C) of the molded member 3A. That is, the antenna device is U-shaped. Thus, although the first, second and third antenna elements 10A, 20A and 30A are provided, the length of the antenna device in a longitudinal direction thereof (the vertical direction as shown in FIGS. 1-3) can be set shorter, and the electronic device incorporating the antenna device can thus be made more compact. Also, since the capacitor element 40 and the high-frequency cable 50 having a given thickness are separated from the molded member 3A in the above manner, the thickness of the antenna device can be set smaller, i.e., it can be set to the thickness of the molded member 3A.

Also, since the antenna device is U-shaped, the distances between the first, second and third antenna elements 10A, 20A and 30A can be set long, as compared with the case where antenna elements are located in a two-dimensional plane. This improves each of the impedances of the first, second and third antenna elements 10A, 20A and 30A, and enables the characteristics thereof to be controlled independently.

Figure 6:
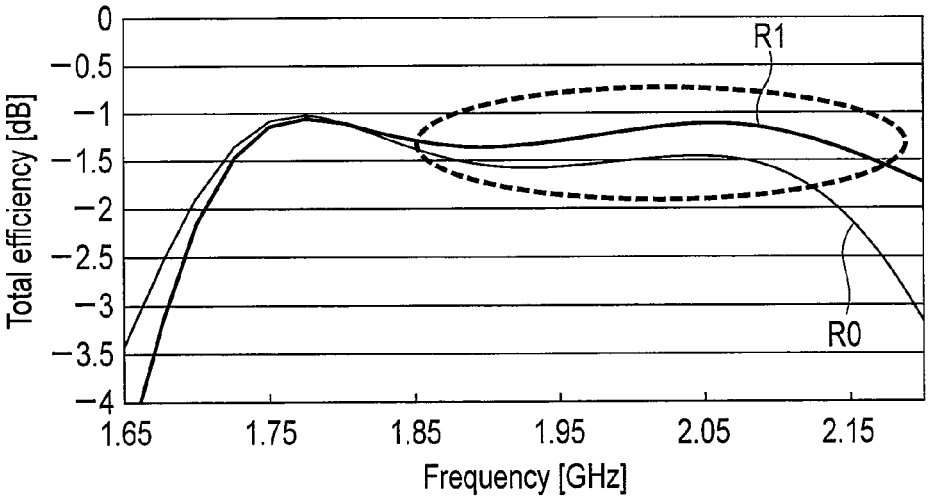
FIG. 6 is an exemplary view for showing a comparison between an example of a total efficiency of the antenna device shown in FIG. 4 which is obtained in the case where a highest resonant frequency is allocated to a second antenna element and that in the case where the highest resonant frequency is allocated to a third antenna element.

Furthermore, since the resonant frequency f2 for the second antenna element 20A, which can increase a radiation resistance, is set lower than the resonant frequency f3 for the third antenna element 30A, the impedance of the third antenna element 30A can be made higher, and as a result a satisfactory antenna characteristic over a wider band can be obtained. FIG. 6 shows a comparison between a total efficiency R1 of the antenna device which is obtained in the case where the resonant frequencies f1, f2 and f3 for the first, second and third antenna elements 10A, 20A and 30A are set to satisfy the relationship "f1<f2<f3" and a total efficiency R0 of the antenna device in the case where the resonant frequencies f1, f2 and f3 are set to satisfy the relationship "f1<f3<f2". As can be seen from FIG. 6, the total efficiency in 1.85 MHz to 2.15 MHz band can be increased.

Furthermore, the distal end portion 22 of the second antenna element 20A is formed flat, and thus a capacitive coupling between the second antenna element 20A and the molded member 3A, which is formed of a dielectric material, can be improved. Thereby, the antenna characteristic of the second antenna element 20A can also be improved.

Furthermore, since the upper surface of the molded member 3A is semicircularly shaped, the flexible printed cable 1 can be located without being folded; i.e., it can be located in a curved state. Thus, the flexible printed cable 1 can be prevented from being broken, and as a result a high reliability of the antenna device can be ensured.

[Second Embodiment]

Figure 4:
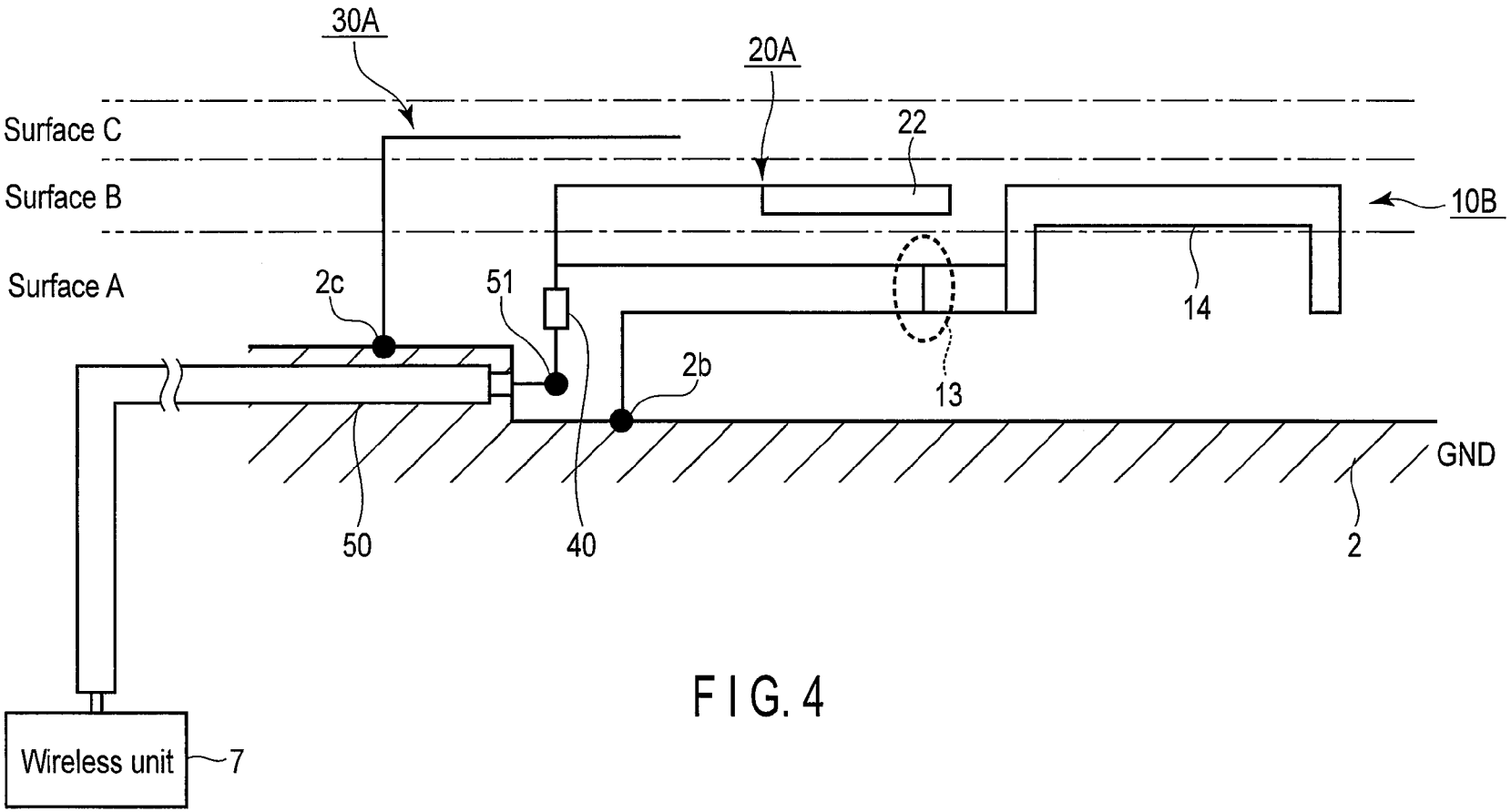
FIG. 4 is an exemplary view showing a two-dimensionally developed state of an antenna device according to a second embodiment.

FIG. 4 is a view showing a two-dimensionally developed stated of an antenna device according to a second embodiment. In FIG. 4, structural elements identical to those shown in FIG. 3 will be denoted by the same reference numerals as in FIG. 3, and their detailed explanations will be omitted.

In the second embodiment, a first antenna element 10B has a distal end portion 14 which is formed U-shaped and also in the shape of a plate. The U-shaped distal end portion 14 is located at the surface B of the molded member 3A. The first, second and third antenna elements 10B, 20A and 30A are located at the surfaces A, B and C of the molded member 3A, respectively. In this regard, the second embodiment is the same as the first embodiment. Also, the resonant frequencies f1, f2 and f3 for the first, second and third antenna elements 10B, 20A and 30A are set to satisfy the relationship "f1<f2<f3" as in the first embodiment.

Therefore, since the distal end portion 14 of the first antenna element 10B is provided at the surface B of the molded member 3A, the radiation resistance of the first antenna element 10B can be made high, and thus the impedance of the antenna device can also be made high, as a result of which the antenna device can perform communication in a wider band, and the radiation efficiency can be improved.

Figure 5:
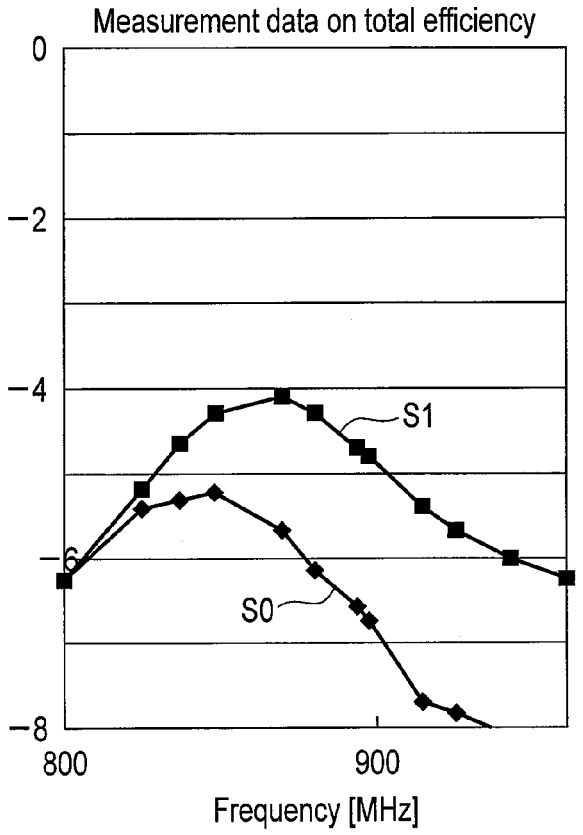
FIG. 5 is an exemplary view for showing a comparison between measurement data on a total efficiency of the antenna device shown in FIG. 3 and that of the antenna device shown in FIG. 4.

FIG. 5 is a view for showing a comparison between measurement data on a total efficiency S1 of the antenna device according to the second embodiment which is obtained as shown in FIG. 4 and measurement data on a total efficiency SO of the antenna device according to the first embodiment which is obtained as shown in FIG. 3. As can be seen from FIG. 5, the total efficiency of the antenna device in 800 MHz to 900 MHz band can be improved by 1 to 2 dB in the case where as shown in FIG. 4, the distal end portion 14 of the first antenna element 10B is provided at the surface B of the molded member 3A.

In such a manner, the antenna device according to the second embodiment can increase the radiation resistance of the first antenna element 10B and also improve its impedance and radiation efficiency, in addition to the advantages obtained by the antenna device according to the first embodiment.

[Third Embodiment]

Figure 7:
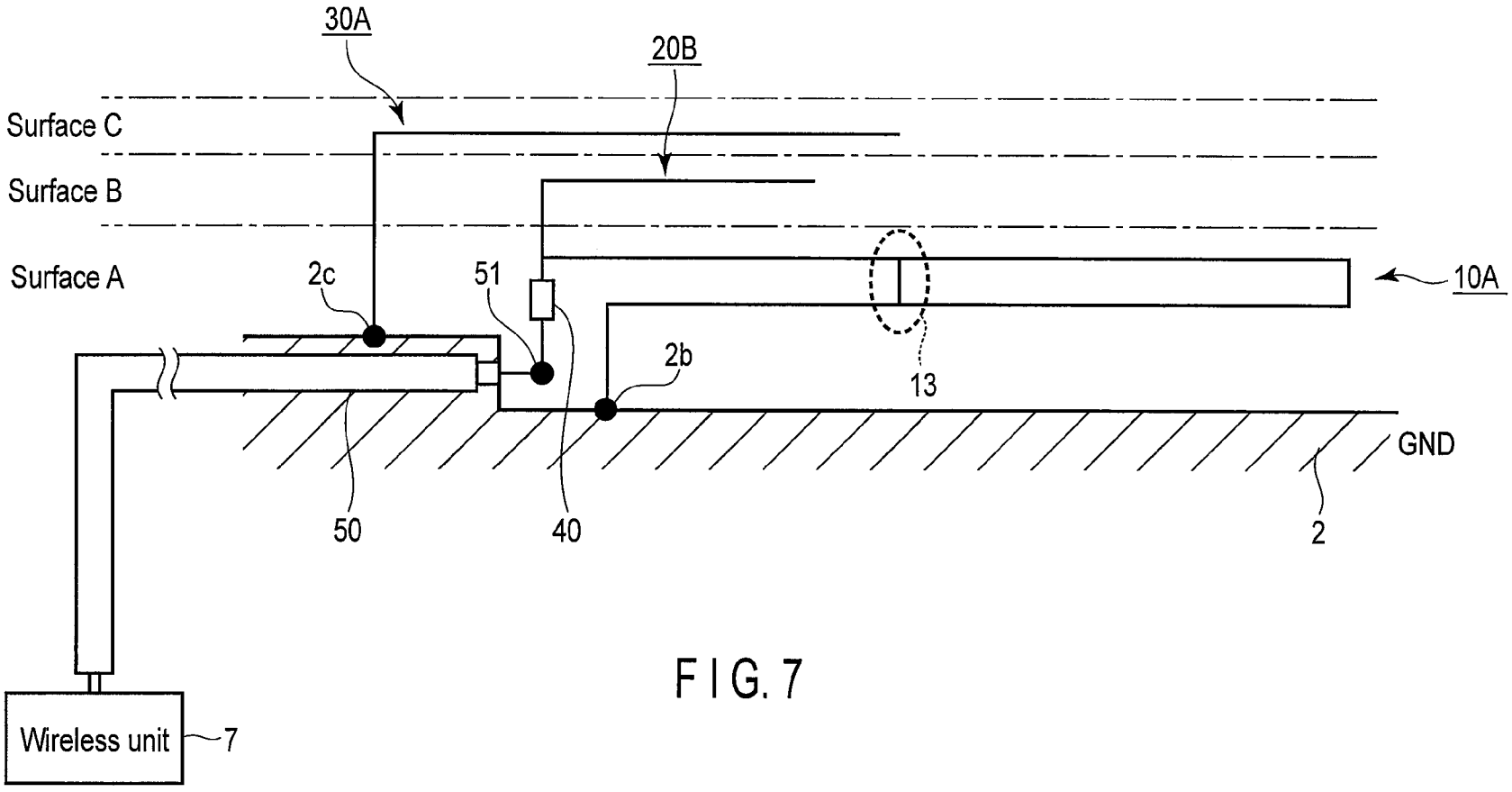
FIG. 7 is an exemplary view for showing a two-dimensionally developed state of an antenna device according to a third embodiment.

FIG. 7 is a view for showing a two-dimensionally developed state of an antenna device according to a third embodiment. In FIG. 7, structural elements identical to those as shown in FIG. 3 will be denoted by the same reference numerals as in FIG. 3, and their detailed explanations will be omitted.

In the third embodiment, a second antenna element 20B has a distal end portion which is formed linearly, not in the shape of a plate. The third antenna element 30A has a horizontal portion which is longer than the horizontal portion of the second antenna element 20B. Thereby, the resonant frequencies f1, f2 and f3 for the first, second and third antenna elements 10A, 20B and 30A are set to satisfy the relationship "f1<f3<f2".

It should be noted that the first, second and third antenna elements 10A, 20B and 30A are provided at the surfaces A, B and C of the molded member 3A, respectively, as in the first and second embodiments.

In the third embodiment, since as described above, the resonant frequencies f1, f2 and f3 for the first, second and third antenna elements 10A, 20B and 30A are set to satisfy the relationship "f1<f3<f2", the total efficiency of the antenna device lowers to some extent, as compared with the case where the resonant frequencies f1, f2 and f3 are set to satisfy the relationship "f1<f2<f3". However, since the antenna device is U-shaped, in the electronic device, the space for providing the antenna device is small and in addition the first, second and third antenna elements 10A, 20B and 30A are separated from each other by a sufficient distance to increase the impedances of these antenna elements.

[Fourth Embodiment]

Figure 8:
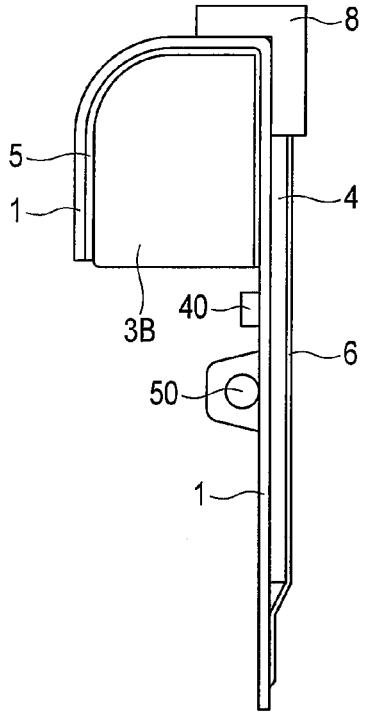
FIG. 8 is an exemplary side view for showing a structure of an antenna device according to a fourth embodiment.

FIG. 8 is a side view showing a structure of an antenna device according to a fourth embodiment. In FIG. 8, structural elements identical to those in FIG. 2 will be denoted by the same reference numerals as in FIG. 2, and their detailed explanations will be omitted.

In the fourth embodiment, a molded member 3B has an upper surface portion which has a corner (right corner)

portion shaped to form a right angle and another corner (left corner) portion shaped arcuately. When the flexible printed cable 1 is placed along a peripheral surface of the molded member 3B, at the corner portion shaped to form the right angle, the flexible printed cable 1 is folded, and at the corner portion shaped arcuately, the flexible printed cable 1 is curved. It should be noted that the flexible printed cable 1 is fixed to the molded member 3B by the adhesive member 5 as in the first embodiment.

Since as stated above, one corner portion of the upper surface portion of the molded member 3B is shaped to form the right angle, the antenna device can be stably set in the housing of the electronic device, with the above right corner portion of the molded portion 3B located in tight contact with a rib 8 of the housing.

[Fifth Embodiment]

Figure 9:
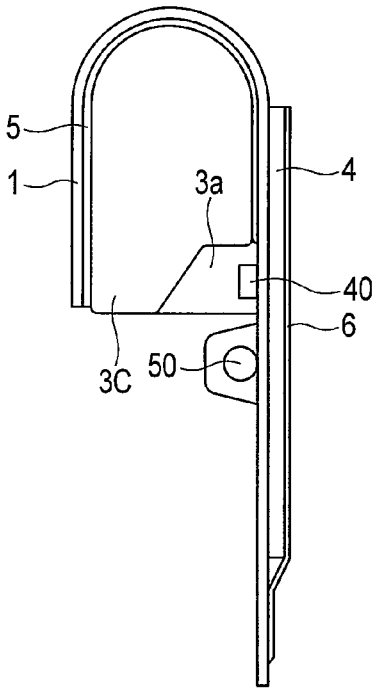
FIG. 9 is an exemplary side view for showing a structure of an antenna device according to a fifth embodiment.

FIG. 9 is a side view for showing a structure of an antenna device according to a fifth embodiment. In FIG. 9, structural elements identical to those in FIG. 2 will be denoted by the same reference numerals as in FIG. 2, and their detailed explanations will be omitted.

In a molded member 3C, one of corner portions of a lower surface portion is partially cut to have a concave portion 3*a*, The concave portion 3*a* provides space for provision of the capacitor element 40. Thereby, the area of the surface C of the molded member 3C can be set greater, and thus the area of part of the flexible printed cable 1 which is stuck on the molded member 3C can also be greater, as a result of which the flexible printed cable 1 can be more strongly fixed to the molded member 3C.

[Other Embodiments]

In each of the above embodiments, the first to third antenna elements are provided at the three surfaces (surfaces A to C) of the molded member, respectively. However, the first antenna element is provided at the surface A, and the second and third antenna elements may be both provided at one of the surfaces B and C.

Also, in each of the above embodiments, the pattern of the first to third antenna elements is provided at the flexible printed cable, and the flexible printed cable is stuck on the peripheral surface of the molded member. However, the pattern may be provided in another manner. That is, the pattern of the first to third antenna elements may be provided at the peripheral surface of the molded member. In this case also, the positional relationship between the first to third antenna elements and the surfaces A to C is the same as that in each of the above embodiments.

In the fifth embodiment, the concave portion 3C is provided in the molded member 3C, and the capacitor element 40 is provided in the space provided in the concave portion 3*a*, However, first and second concave portions may be provided in the molded member 3C, and the capacitor element 40 and the high-frequency cable 50 may be provided in space provided in the first concave portion and that in the second concave portion, respectively.

The structures and positions of the first to third antenna elements, the values of the resonant frequencies for those antenna elements, the positions of the capacitor element and high-frequency cable, etc., may be variously modified without departing from the subject matter of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a base member formed of a dielectric material and comprising first, second, and third surfaces, wherein the first surface and the third surface are opposite to each other and the second surface connects the first surface and the third surface; and a flexible board attached to the base member, the flexible board comprising a first antenna, a second antenna, a third antenna, a capacitor element, and a grounding pattern, wherein the flexible board further comprises a first area located at the first surface, a second area located at the second surface, a third area located at the third surface, and a fourth area being an extension of the first area;

the grounding pattern is formed in the fourth area and comprises a first side and a second side, the first side includes a first grounding terminal, the second side is closer to the first area than the first side and comprises a second grounding terminal;

the first antenna element is formed in the first area and comprises a folded-type monopole element having a first end and a second end, the first end being connected to a feeding point, the second end being connected to the first grounding terminal, the folded-type monopole element including an intermediate portion folded to divide the folded-type monopole element into a forward-path portion and a backward-path portion, and a stub being located between the forward-path portion and the backward-path portion;

the second antenna element is formed in the second area and comprises a monopole element having a third end and a fourth end, the third end being directly connected to the feeding point or indirectly connected to the feeding point by part of the first antenna element, and the fourth end of the monopole element comprising a plate and being free, wherein at least a distal end portion of the monopole element is located to extend in parallel with the first antenna element;

the third antenna element is formed in the third area and comprises a passive element having a fifth end and a sixth end, the fifth end being connected to the second grounding terminal, the sixth end being free, wherein at least part of the passive element is located to extend in parallel with the second antenna element to achieve capacitive coupling between the at least part of the passive element and the second antenna element; and the capacitor element is formed in the fourth area and is between the feeding point and the stub in the backward-path portion of the first antenna element.

2. The antenna device of claim 1, wherein an electrical length of the first antenna element from the feeding point to the first grounding terminal through the intermediate portion is in accordance with a wavelength corresponding to a first resonant frequency;

an electrical length of the second antenna element from the feeding point to the fourth end is in accordance with a wavelength corresponding to a second resonant frequency higher than the first resonant frequency; and an electrical length of the third antenna element from the second grounding terminal to the sixth end is in accordance with a wavelength corresponding to a third resonant frequency higher than the second resonant frequency.

3. The antenna device of claim 2, wherein a part of the folded-type monopole element of the first antenna element which is closer to a distal end than the stub comprises a line or a plate.

4. The antenna device of claim 2, wherein the second surface of the base member is formed to arcuately project.

5. The antenna device of claim 2, wherein the first surface of the base member includes a concave portion and the capacitor element is located within the concave portion.

6. The antenna device of claim 2, wherein the second side is formed in a projected area projected to the first area than the first side, and a high-frequency cable is connected to the feeding point and located at the projected area.

7. An electrical device comprising:

a wireless unit configured to transmit and receive a radio signal;

an antenna device that comprises a base member formed of a dielectric material and comprising first, second, and third surfaces, wherein the first surface and the third surface are opposite to each other and the second surface connects the first surface and the third surface; and a flexible board attached to the base member, the flexible board comprising a first antenna, a second antenna, a third antenna, a capacitor element, and a grounding pattern, wherein the flexible board comprises a first area located at the first surface, a second area located at the second surface, a third area located at the third surface, and a fourth area which is an extension of the first area, the grounding pattern is formed in the fourth area and comprises a first side and a second side, the first side comprising a first grounding terminal, the second side closer to the first area than the first side and comprising a second grounding terminal, the first antenna element is formed in the first area and comprises a folded-type monopole element having a first end and a second end, the first end being connected to a feeding point, the second end being connected to the first grounding terminal, the folded-type monopole element including an intermediate portion folded to divide the folded-type monopole element into a forward-path portion and a backward-path portion, and a stub being located between the forward-path portion and the backward-path portion, the second antenna element is formed in the second area and comprises a monopole element having a third end and a fourth end, the third end being directly connected to the feeding point or indirectly connected to the feeding point by part of the first antenna element, and the fourth end of the monopole element comprising a plate and being free, wherein at least a distal end portion of the monopole element is located to extend in parallel with the first antenna element, the third antenna element is formed in the third area and comprises a passive element having a fifth end and a sixth end, the fifth end being connected to the second grounding terminal, the sixth end being free, wherein at least part of the passive element is located to extend in parallel with the second antenna element to achieve capacitive coupling between the at least part of the passive element and the second antenna element, and the capacitor element is formed in the fourth area and is between the feeding point and the stub in the backward-path portion of the first antenna element and a high-frequency cable connecting the antenna device and the wireless device.

8. The electrical device of claim 7, wherein an electrical length of the first antenna element from the feeding point to the first grounding terminal through the intermediate portion is in accordance with a wavelength corresponding to a first resonant frequency;

an electrical length of the second antenna element from the feeding point to the fourth end is in accordance with a wavelength corresponding to a second resonant frequency higher than the first resonant frequency; and an electrical length of the third antenna element from the second grounding terminal to the sixth end is in accordance with a wavelength corresponding to a third resonant frequency higher than the second resonant frequency.

9. The electrical device of claim 8, wherein the second surface of the base member is formed to arcuately project.

10. The electrical device of claim 8, wherein the first surface of the base member includes a concave portion and the capacitor element is located within the concave portion.

11. The electrical device of claim 8, wherein a part of the folded-type monopole element of the first antenna element which is closer to a distal end than the stub comprises a line or a plate.

12. The electrical device of claim 8, wherein the second side is formed in a projected area projected to the first area than the first side, and the high-frequency cable is located at the projected area.

13. An antenna device comprising:

a base member formed of a dielectric material and comprises a plurality of surfaces including a first surface, a third surface, and a second surface interposed between the first surface and the third surface; and a flexible board attached to the base member, the flexible board comprises a first antenna, a second antenna, a third antenna, a capacitor element, and a grounding pattern, wherein the flexible board further comprises a first area located at the first surface, a second area located at the second surface, a third area located at the third surface, and a fourth area that is an extension of the first area;

the grounding pattern is formed in the fourth area and comprises a first side and a second side, the first side comprises a first grounding terminal, the second side is positioned closer to the first area than the first side and comprises a second grounding terminal;

the first antenna element is formed in the first area and comprises a folded-type monopole element having a first end and a second end, the first end is connected to a feeding point, the second end is connected to the first grounding terminal, the folded-type monopole element includes an intermediate portion folded to divide the folded-type monopole element into a forward-path portion and a backward-path portion, and a stub is located between the forward-path portion and the backward-path portion;

the second antenna element is formed in the second area and comprises a monopole element having a third end and a fourth end, the third end is either directly connected to the feeding point or indirectly connected to the feeding point by part of the first antenna element, a distal end portion of the monopole element extends in parallel with the first antenna element;

the third antenna element is formed in the third area and comprises a passive element having a fifth end that is connected to the second grounding terminal and a sixth end, wherein at least part of the passive element is located to extend in parallel with the second antenna element to achieve capacitive coupling between the at least part of the passive element and the second antenna element; and the capacitor element is formed in the fourth area and is between the feeding point and the stub in the backward-path portion of the first antenna element.

14. The antenna device of claim 13, wherein a part of the folded-type monopole element of the first antenna element which is closer to a distal end than the stub comprises a line or.

15. The antenna device of claim 13, wherein the second surface of the base member is formed to arcuately project.

16. The antenna device of claim 13, wherein the first surface of the base member includes a concave portion and the capacitor element is located within the concave portion.

17. The antenna device of claim 13, wherein an electrical length of the first antenna element from the feeding point to the first grounding terminal through the intermediate portion is in accordance with a wavelength corresponding to a first resonant frequency;

an electrical length of the second antenna element from the feeding point to the fourth end is in accordance with a wavelength corresponding to a second resonant frequency higher than the first resonant frequency; and an electrical length of the third antenna element from the second grounding terminal to the sixth end is in accordance with a wavelength corresponding to a third resonant frequency higher than the second resonant frequency.

18. The antenna device of claim 17, wherein the second side is formed in a projected area projected to the first area than the first side, and a high-frequency cable is connected to the feeding point and located at the projected area.

* * * * *